United States Patent [19]

Zweifel

[11] Patent Number: 5,003,893

[45] Date of Patent: Apr. 2, 1991

[54] METHOD AND PLANT FOR BURNING SPECIAL WASTE

[76] Inventor: Martin R. Zweifel, Bahnhofstrasse 48, CH-5430 Wettingen, Switzerland

[21] Appl. No.: 388,031

[22] Filed: Jul. 28, 1989

[30] Foreign Application Priority Data

Jul. 29, 1988 [CH] Switzerland ..... 2892/88

[51] Int. Cl.[5] ..... F23G 7/06

[52] U.S. Cl. ..... 110/346; 110/246; 110/238

[58] Field of Search ..... 110/246, 346, 226, 246, 110/210, 211, 238, 212, 184; 98/60

[56] References Cited

U.S. PATENT DOCUMENTS

| | | | |
|---|---|---|---|
| 2,706,395 | 4/1955 | McCrea | 110/184 |
| 3,664,277 | 5/1972 | Chatterjee et al. | 110/212 |
| 3,785,306 | 1/1974 | Jaget, deceased et al. | 110/246 |
| 3,842,762 | 10/1974 | Sargent et al. | 110/246 |
| 3,937,154 | 2/1976 | Hughes, Jr. | 110/212 |
| 4,583,469 | 4/1986 | DiSabatino | 110/212 |
| 4,728,081 | 3/1988 | Nishino et al. | 110/246 |
| 4,763,583 | 8/1988 | Przewalski | 110/246 |
| 4,768,445 | 9/1988 | Vollhardt et al. | 110/246 |
| 4,815,399 | 3/1989 | Vollhardt | 110/246 |

FOREIGN PATENT DOCUMENTS

| | | | |
|---|---|---|---|
| 1950975 | 4/1971 | Fed. Rep. of Germany | 110/212 |
| 87581 | 8/1978 | Japan | 110/226 |

*Primary Examiner*—Edward G. Favors
*Assistant Examiner*—Denise L. Gromada

[57] ABSTRACT

In a method and a plant for the combustion of special waste, a combustion chamber is connected downstream of a tubular revolving furnace which receives waste to be burnt. A part of the special refuse, particularly gaseous and liquid refuse is introduced into the combustion chamber and is burnt therein by a burner. A revolving tube of the revolving furnace opens into a lower conically downwardly tapering area of the combustion chamber which is constructed as an upright tube. The flue gases produced in the tubular revolving furnace flow from the bottom of the top of the combustion chamber together with the flue gases produced in the combustion chamber. Secondary air is also introduced into the combustion chamber so that there is ensured an extremely good, complete burning up of the waste to the end of the combustion chamber. Due to the fact that part of the special waste is burnt-out in the combustion chamber, the dimensions of the tubular revolving furnace can be reduced.

5 Claims, 1 Drawing Sheet

METHOD AND PLANT FOR BURNING SPECIAL WASTE

BACKGROUND OF THE INVENTION

The present invention relates to a method for burning gaseous, liquid or solid industrial waste, known as special waste, making use of a tubular revolving furnace with a secondary combustion chamber connected in series therewith.

Considerable problems are encountered in disposing of the waste occurring in industry, particularly in the case of toxic, hazardous or pathogenic waste. In the case of the pathogenic waste, covered by the general term "special waste", considerable efforts have to be made now in connection with the disposal of such waste. For much of such waste, disposal is possible by burning in conventional plants. However, special measures must be taken to ensure a constant combustion and, in addition, official requirements and regulations must be satisfied.

In a known plant, use is made of a tubular revolving furnace, the end of which opens into a secondary combustion chamber, where an afterburning of the flue gases received from the furnace takes place. Most of the special waste is burnt out in the revolving tubular furnace. During the burning process, a prerequisite for trouble-free operation is a precise equilibrium of the waste materials, in accordance with the characteristics established prior to burning. However, not only correct temperatures in the tubular revolving furnace are essential for efficient burning, but it is equally important to have sufficiently long residence times. Only then is it possible to achieve an efficient burning of the gases and solids, accompanied by the complete burning of the residual materials.

At the intake-side, water-cooled end wall of the tubular revolving furnace, there are provided filling devices for solid waste, and drums, as well as burners and lances for liquid flammable materials, sludge, polymerizing waste, etc., and also for optional support fuels. Nozzles for the primary combustion air are also provided. The secondary combustion or afterburning chamber following the furnace includes injection devices for liquid waste, particularly aqueous waste without or only with a low calorific value, as well as secondary air nozzles and an additional support burner. Basically all the special refuse is introduced via the intake end wall into the revolving tubular furnace and burnt out, apart from waste water and sewage without or with a low calorific value, which is injected into the afterburning chamber. If such waste water was burnt in the tubular revolving furnace, it would lead to an excessive reduction of the combustion temperature. It is also possible to directly introduce a fermentation gas into the secondary combustion or afterburning chamber, because this gas very rapidly completely burns.

Solids and sludge are fed in via the intake-side end wall to maintain a specific basic loading of the furnace. For automatically controlling the temperature of the revolving tubular furnace use is made of a multicomponent burner, optionally with a lance, enabling gas and also high caloric, liquid waste to be burnt. These materials can be injected individually or in combination with other materials. Said burner is, on the one hand, integrated into the temperature control circuit of the afterburning chamber (the temperature in the tubular revolving chamber and in the afterburning chamber can be set at between 950° and 1300° C.) and, on the other hand, in the control loop, which controls the quantity of steam or hot water of a boiler plant connected downstream of the combustion part of the installation. This burner has its own combustion air supply and is also used as a starting burner.

The main air quantity for combustion in the revolving tubular furnace is called the primary air. The separate introduction of primary air through the end wall of the furnace improves the oxidation conditions, in that the oxidation of the volatile elements also takes place in the solid bed forming in the furnace.

Thus, substances undergo afterburning in the afterburning chamber, which have not yet reacted in the tubular revolving furnace. The unburnt gases and solid particles mainly occur during the combustion process and, in particular, at the end of the revolving tubular furnace, where the residence time is too short in order to completely burn the substances. This afterburning in the afterburning chamber is assisted by the secondary air, which is introduced into the afterburning chamber under high pressure.

Therefore, the flue gases leave the afterburning chamber in a completely burnt-out state and are cooled in the following radiation part of the downstream boiler to approximately 650° C. Following the boiler, the gases pass through a filtering plant, in which most of solid particles are separated from the gas flow.

Known plants of the afore-described type operate reliably and achieve a high number of operating hours every year. However, since essentially all the waste is burnt in the revolving tubular furnace, it must be dimensioned for this quantity and costs are largely determined by the furnace dimensions.

SUMMARY OF THE INVENTION

It is an object of the present invention to provide an improved method of the aforementioned type with which it would be possible to substantially reduce dimensions of the tubular revolving furnace, without, however, reducing the capacity of the plant.

According to the invention this and other objects of the invention are attained in that the secondary chamber is constructed as a combustion chamber and only part of the waste is burnt-out in the tubular revolving furnace, the remainder of the waste, particularly gaseous and liquid waste, being supplied to the combustion chamber, where it is completely burnt. As only part of the waste is burnt in the tubular revolving furnace, the dimensions of which can be reduced by the capacity of the plant is maintained, because now the remainder of the waste is burnt-out in the combustion chamber connected downstream of the furnace. It is possible to achieve just as complete a burning of the gases in the combustion chamber as in the known plant.

The present invention also covers a plant for performing the method in an optimal manner.

According to the invention the plant includes a combustion chamber which tapers conically in the lower end region thereof and the end of the tubular rotary furnace opens into said lower region and wherein at least one burner for introducing gaseous and liquid materials of the remainder of the waste is positioned in the combustion chamber.

The invention is described in greater detail hereinafter relative to an embodiment and the attached drawings.

DETAILED DESCRIPTION OF THE PREFERRED EMBODIMENT

Figure 1:
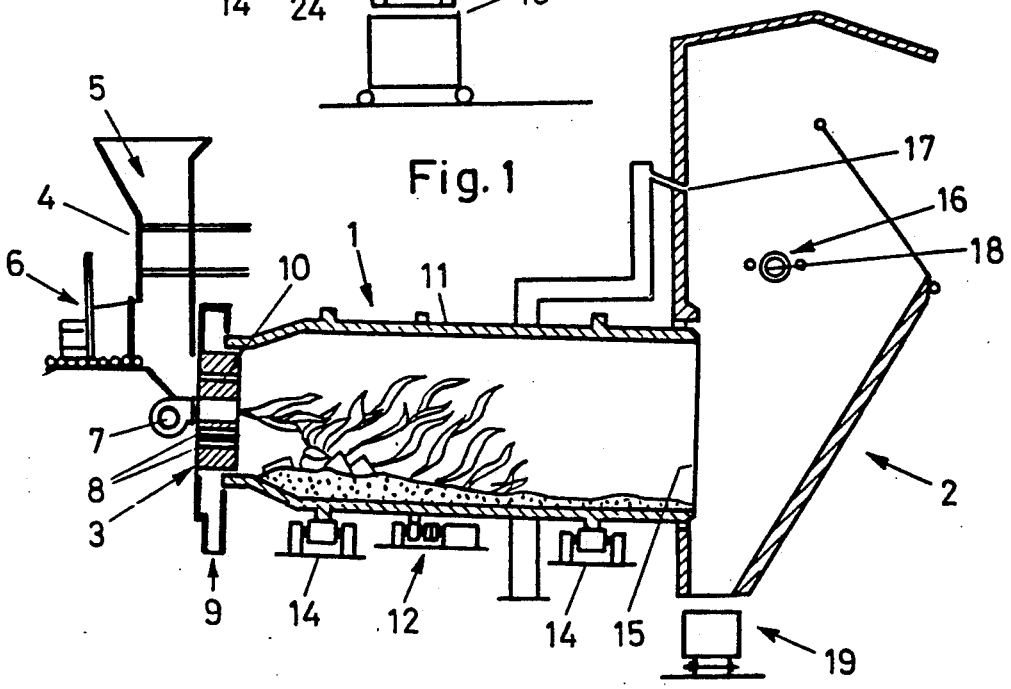
FIG. 1 is a diagrammatically shown vertical section through a plant for the combustion of special waste according to prior art.

FIG. 1 shows that part of a known plant for burning special waste, which covers the actual combustion system. Upstream of the combustion system, are provided devices in which, prior to combustion, the incoming waste is classified and made ready, so that the combustion can be maintained in an optimal manner by the combination of different waste types. The combustion plant comprises as the essential parts a tubular revolving furnace 1 and an afterburning chamber 2, whereby in the latter complete burning of the flue gases produced in the furnace 1 during the burning of the waste takes place.

On the intake side, the tubular revolving furnace 1 has a water-cooled end wall 3, on which is provided a filling device 4 including an inlet hopper for solid waste 5 and drums 6. Burners 7 and lances 8 are used for the introduction of liquid flammable materials and sludge, polymerizing waste and, if necessary, support fuel. Air nozzles 10 are used for the introduction of the primary combustion air.

The fixed end wall 3 closes off a revolving tube 11, which is supported for rotation on mounting supports 14 and the speed of which is adjustable, depending on the nature of the burnt waste, by means of a drive 12. The discharge side end of the revolving tube 11 forms an opening or mouthpiece 15 with an opening diameter corresponding to the tube diameter. The discharge end of tube 11 projects through the wall of the secondary afterburning chamber 2 into the lower part thereof. The secondary afterburning chamber 2 has an injection device 16 for injecting liquid waste, particularly aqueous waste without any calorific value into chamber 2 and secondary air nozzles 17, as well as an additional support burner 18. The support burner 18 ensures that the temperature required for the combustion process is maintained and is consequently only temporarily in operation.

The afterburning chamber 2 ensures that all the substances which have not reacted in the revolving tube 11 are completely burnt-out. The afterburning process is supported by secondary air introduced into chamber 2 by means of the secondary air nozzles 17.

The secondary air is provided in order to compensate temperature profiles in the afterburning chamber.

The gases burnt-out in the afterburning chamber 2 leave the same in the upward direction towards a boiler plant. The gases are subsequently cleaned in a filtering installation and most of the solids contained therein are separated therefrom. Solid particles which sink into the lower part of the afterburning chamber 2, are removed therefrom through a slag discharge opening 19.

Figure 2:
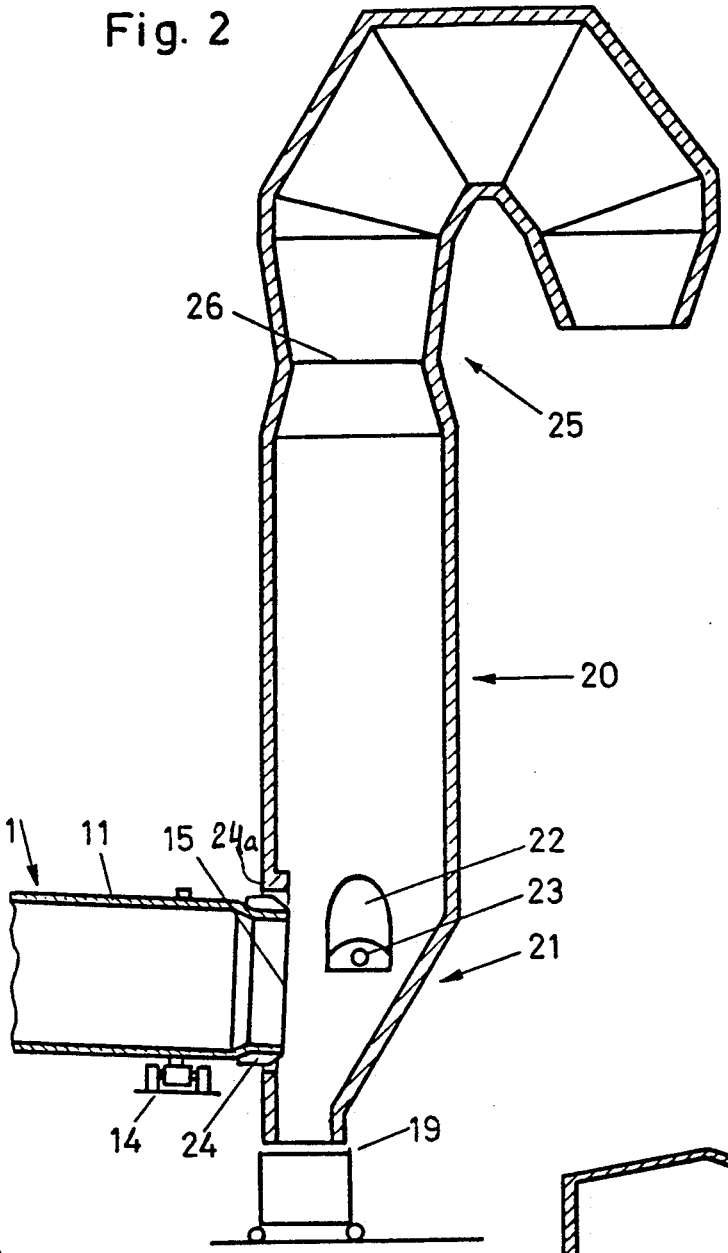
FIG. 2 is a diagrammatically shown vertical section through the combustion chamber connected downstream of a tubular revolving furnace for burning gaseous and liquid, flammable materials, according to the present invention.

FIG. 2 shows a plant according to the invention for the combustion of special waste. FIG. 2 only partly shows the revolving tube 11 of the tubular revolving furnace 1, because the non-shown part of the plant remains unchanged as compared with the known plants. According to the invention, a combustion chamber 20 is connected to the revolving tube 11. Unlike in the case of the secondary or afterburning chamber, the combustion chamber 20 is used for burning parts of the special waste and in particular gaseous and liquid, mainly high caloric materials. For this purpose, the lower part 21 of combustion chamber 20 has a device 22 for the introduction of said materials and which comprises one or more burners 23. These burners are arranged in such a way that the gaseous and liquid waste materials are introduced into the center of the vertical flow forming in combustion chamber 20. The latter is essentially constructed as an elongated, upright, tubular chamber, which tapers conically in the lower part 21 thereof. Lower part 21 also has opening thereinto the opening 15 of the revolving tube 11 of the tubular revolving furnace. As the revolving tube 11 revolves, a sealing device 24 which is incorporated for sealing the opening 15 with respect to the wall **24*a* of combustion chamber 20 brings about the necessary seal by means of shoes sliding on tube 11** and used in known plants for the combustion of special waste.

At the bottom end of the conical part of the lower region 21 of the combustion chamber 20 is provided, as in known plants, a slag discharge opening 19 through which it is possible to remove the slag sinking in combustion chamber 20.

Wall 24 of combustion chamber 20 has nozzles for introducing secondary air (not shown) and lances for introducing liquid waste without or with only a very low calorific value (not shown). These nozzles and lances have an approximately tangentially directed axis and consequently produce in operation a turbulent flow in the combustion chamber 20.

Combustion chamber 20 has a greater height than the known secondary afterburning chambers. However, as other parts of the complete plant have an even greater height, this does not represent a disadvantage. In fact, through the length of the combustion chamber 20, its tubular construction and dimensioning, as well as through the provision of secondary air nozzles, a flow in combustion chamber 20 is obtained, which ensures up to the upper end 25 thereof, an extremely efficient complete combustion of the flue gases, which is at least as good as that of a known plant with a tubular revolving furnace and afterburning chamber.

While particular embodiments of the present invention have been shown as described, it will be obvious to those skilled in the art that changes and modifications may be made without departing from the invention in its broader aspects. Therefore, the aim in the appended claims is to cover all changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

At the upper end of combustion chamber 20, is provided a constriction 26, which intensifies the turbulent flow through the acceleration of the flue gas flow. In addition, through the combustion of the remainder of the waste introduced in the center of combustion chamber 20, a flue gas flow is formed, which provides additional energy for the formation of the turbulent flow in the combustion chamber 20. Oxygen introduced through the secondary air leads to a complete combustion of the flue gases rising in combustion chamber 20.

Combustion chamber 20 completely burns the flue gases entering from below from the revolving tube 11. Simultaneously, the gaseous and liquid waste are injected, also from below into chamber 20, in the center of the cross-section of the combustion chamber. Gaseous and waste materials are burnt as they flow from the bottom to the top through the combustion chamber 20 and are completely burnt-out at the upper end 25 of the chamber. At the upper end 25, where the combustion chamber has the conical constriction 26, the remaining mixing of the flue gases entering the combustion chamber from revolving tube 11 and the flue gases produced by the combustion of the waste introduced directly into the combustion chamber 20 takes place. The flue gases flow towards the discharge end of the combustion chamber 20. The combustion chamber 20 is manufactured in a known manner. On the inside of a sheet metal jacket forming the outer boundary of combustion chamber 20 is provided a refractory brickwork, which can in a known manner be formed e.g. from firebricks. Revolving tube 11 is also constructed in the same way.

What is claimed is:

1. Method for the combustion of gaseous, liquid and solid industrial waste, the method comprising the steps of providing a first tubular revolving furnace and connecting a second furnace formed as an elongated, upright combustion chamber to said first tubular revolving furnace in series, providing each of said first and second furnaces with means for introducing waste materials thereinto, supplying only part of the waste into and burning said part in the first tubular revolving furnace and supplying the remainder of the waste including gaseous and liquid waste to the combustion chamber, supplying into said combustion chamber a combustion air and, simultaneously with and in addition to said combustion air, supplying a secondary air into said combustion chamber to obtain a complete burning of the waste, wherein flue gases resulting from combustion of the part of waste in the tubular revolving furnace are introduced into the combustion chamber and mixed with flue gases resulting from the combustion of the remainder of the waste and wherein the secondary air is supplied approximately tangentially into the combustion chamber so that a vortex flow, which is intensified by a constriction provided at an upper end of the combustion chamber, is formed in the combustion chamber.

2. Method according to claim 1, wherein the remainder of the waste is supplied into the combustion chamber in a center thereof, whereby a vertically upwardly directed flow is produced in the combustion chamber.

3. Plant for the combustion of gaseous, liquid and solid industrial waste, comprising a first tubular revolving furnace having an outlet and a second furnace formed as an elongated, upright, tubular combustion chamber having a substantially constant cross-section above a lower end region thereof and being connected to said outlet at said lower end region thereof, said first tubular revolving furnace having an inlet to receive only part of the waste which is burnt therein, said combustion chamber including st least one burner located in said lower end region for introducing gaseous and liquid substances of the remainder part of the waste into said combustion chamber, nozzle means for introducing secondary air into said combustion chamber, and lances for introducing contaminated water having a very low calorific value into said combustion chamber provided in an area of the combustion chamber with the constant cross-section, said nozzle means being constructed so that the secondary air is supplied into said combination chamber approximately tangentially thereof to produce a vortex flow therein, said combustion chamber conically tapering in said lower end region and also in an upper end region thereof above said constant cross-section.

4. Plant according to claim 3, wherein said combustion chamber at said upper end region is constricted to intensify said vortex flow and subsequently merges into a widened channel forming a discharge end of said combustion chamber.

5. Plant according to claim 3, wherein said first tubular revolving furnace is a substantially horizontal tube having one end thereof forming said outlet which opens into said lower region of said combustion chamber, whereby flue gases produced in said first furnace and said combustion chamber flow upwardly towards a discharge end of said combustion chamber.

* * * * *